United States Patent [19]

Hodge et al.

[11] 4,148,411

[45] Apr. 10, 1979

[54] NON-JAMMING BIN LID SYSTEM

[76] Inventors: Allan M. Hodge, 5852 Lomond Dr., San Diego, Calif. 92120; Craig V. Taylor, 8924 Enfield Ave., Northridge, Calif. 91324

[21] Appl. No.: 898,381

[22] Filed: Apr. 20, 1978

[51] Int. Cl.[2] ..... B65D 43/14; B65D 51/04

[52] U.S. Cl. ..... 220/331; 220/1 T; 220/335

[58] Field of Search ..... 220/1 T, 331, 345, 335, 220/346, 349, 318

[56] References Cited

U.S. PATENT DOCUMENTS

| | | | |
|---|---|---|---|
| 3,989,162 | 11/1976 | Hodge et al. | 220/331 |
| 3,994,415 | 11/1976 | Hodge | 220/331 |
| 4,014,457 | 3/1977 | Hodge | 220/331 |

*Primary Examiner*—George T. Hall

*Attorney, Agent, or Firm*—Poms, Smith, Lande, Glenny & Rose

[57] ABSTRACT

A balanced lid type system for industrial trash bins includes arrangements for partially opening the lid with little effort and for permitting the lid to swing wide open when it is inverted for dumping, as disclosed in U.S. Pat. Nos. 3,994,415 and Re. 29,494. The operative mechanism in the present balanced lid bin system includes rollers which ride on the top edge of the sides of the bin to support the lid in a substantially balanced manner, and a pair of recesses or guideways in the rear sides of the lid which engage matching pins or rollers extending laterally from the bin to guide the lid as it rotates open in the upright or balanced partially opening mode of operation. When the lid swings wide open, as it is inverted when raised by the forks of a lift garbage dump truck, the rollers remain at the end of the tracks in the lid and the lid swings fully open about this axis. In the wide-open position, the tracks of the lid make a substantial angle with the vertical, so that vibration of the bin to assure complete emptying of it, will not jam or damage the tracks or mating roller assemblies.

9 Claims, 5 Drawing Figures

NON-JAMMING BIN LID SYSTEM

FIELD OF THE INVENTION

The present invention relates to balanced lid type commercial trash bin and lid assemblies.

BACKGROUND OF THE INVENTION

Initially, reference is made to my prior U.S. Pat. Nos. Re. 29,494, and 3,994,415. The arrangement shown in U.S. Pat. No. 3,994,415 has proved to be particularly useful for certain applications. In the arrangement shown in this last-mentioned patent, the balanced lid is provided with rollers which ride on the upper rim of a commercial trash bin as the balanced lid is partially opened in the upright position. A pair of additional rollers extend inwardly from the rear corners of the lid and engage a curved track which is fixed to the upper rear sides of the commercial trash bin. As the lid is partially opened in the upright orientation, the rollers at the rear corners of the lid are guided downwardly in the two tracks and the supporting rollers near the center of gravity of the lid roll back along the upper surface of the trash bin until a stop is engaged. When the trash bin is inverted to empty it, the lid rotates about the pins in the upper end of the generally vertically extending track. Then, however, when the trash bin is shaken, to completely empty all waste or trash material from it, the lid is vibrated in the vertical plane in an irregular manner and occasionally one of the pins slides up the vertically extending track and jams or deforms either the lid or the track as a result of the uneven stresses which occur when one pin, but not the other, rides up in its track.

A principal object of the present invention is to avoid this damage which has occurred in balanced lid type trash bin systems utilizing roller and track guides.

SUMMARY OF THE INVENTION

In accordance with the present invention, a balanced lid type commercial trash bin and lid system is provided with a track in the lid instead of on the trash bin, and rollers on the bin instead of on the lid. Further, the track is oriented at a significant angle with respect to the vertical when the lid is in the wide open position when the bin is inverted for dumping, thereby preventing oscillation of the lid along the track and the resultant jamming which has plagued this type of tracked assembly.

A synergistic advantage is provided by the dual function performed by the lid mounted track. Initially, in the upright position it guides the rear of the lid; and then in the upside-down orientation it provides a constraining pivot point, impervious to vertical oscillations which have damaged assemblies of this type where the track was mounted on the bin.

Other objects, features, and advantages of the invention will become apparent from a consideration of the following detailed description and from the drawings.

DETAILED DESCRIPTION

Figure 1:
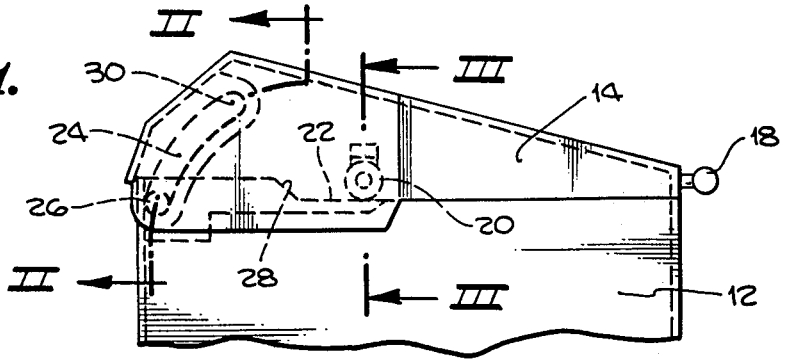
FIG. 1 shows the trash bin and balance lid assembly in accordance with the invention with the lid in the closed position.

Referring more particularly to the drawings, FIG. 1 shows a commercial trash bin 12 provided with a lid 14, and pocket tubes 16 by which the commercial bin may be raised, and inverted, so that the trash in it may be dumped into a garbage truck. The bin and lid assembly of the present invention is of particular interest in that the lid may be partially opened with very little effort, because it is substantially balanced as it is opened when the bin 12 is in the upright orientation. On the other hand, when the entire bin and lid 12, 14 are inverted, as shown in FIG. 5, the lid swings wide open so that the emptying of the trash bin 12 is not impeded by the presence of the lid 14.

Figure 2:
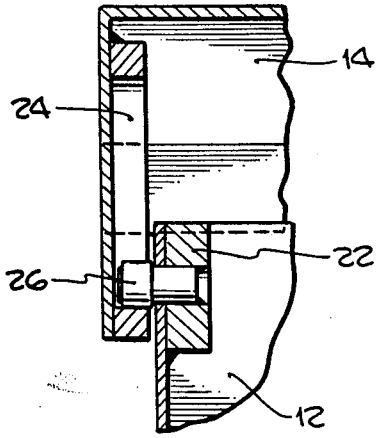
FIG. 2 is a partial cross-sectional view taken along lines II—II of FIG. 1.
Figure 3:
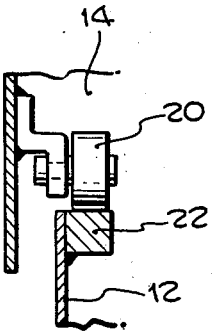
FIG. 3 is a partial cross-sectional view taken along lines III—III of FIG. 1.
Figure 4:
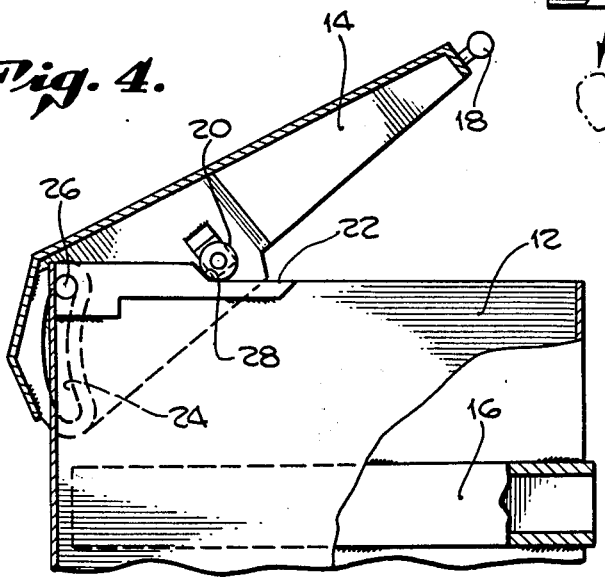
FIG. 4 is a cross-sectional view through the center of the lid and commercial trash bin assembly showing the lid in the partially open condition for emptying trash into the bin.

Now, returning to FIGS. 1, 2 and 3, it may be noted that FIGS. 2 and 3 are partial cross-sectional views taken along lines II—II and III—III of FIG. 1. When the lid is partially opened with the bin 12 in the upright orientation, the user grasps the handle 18 and raises the lid 14, which is supported in a very nearly balanced condition on the rollers 20 which ride on the upper rim 22 of the bin 12. To guide the rear of the lid 14 in its downward motion encompassing the rear of the bin 12, a pair of tracks are provided, one of which is located at each end on the inside rear of the sides of the lid. One such track is shown at 24, with the pin or roller 26 which is secured to the upper rear corner of the bin 12. A similar track and pin assembly is located at the opposite end of the lid and bin precisely aligned with the track 24 and pin 26 as shown in FIG. 1. Accordingly, when the handle 18 is raised the roller 20 rolls back along the track 22 and the recessed track 24 rides downwardly while encompassing the pin 26 which is fixed in position. The track 22 on the upper rim of the trash bin 12 is provided with an inclined surface 28 which is engaged by the roller 20 at about the same time that the pin 26 engages the upper end 30 of the track 24. Either or both of these stops holds the lid 14 in the partially open position as shown in FIG. 4 for the depositing of garbage into it.

Figure 5:
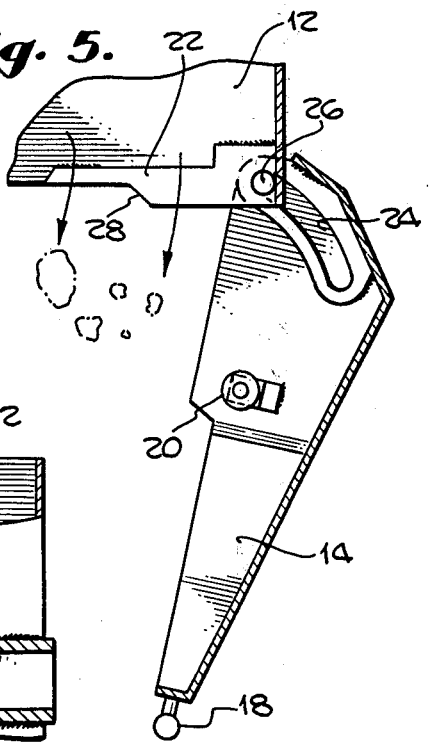
FIG. 5 shows the trash bin inverted with the lid wide open.

When the trash bin 12 is to be emptied, a garbage truck inserts the tines of its forklift into the pocket tubes 16 and swings the trash bin 12 with its associated lid 14 up and over the cab so that the trash bin is emptied into the garbage truck in the upside-down orientation as shown in FIG. 5. When the bin is in this position above the garbage truck, the operator frequently shakes the bin giving it some vigorous vertical oscillations in the course of such shaking. With previous arrangements in which the fixed pins were secured to the lid and generally vertically extending tracks were located along the rear edge of the bin, one end or the other end of the lid would tend to slide up the track giving very intense pressure as the result of this camming action, with the result that the tracks, the pins or the lids would frequently be deformed and damaged.

In accordance with the present invention, with the track 24 being located on the lid, with the lid being pivoted by 90° from the initial orientation as shown in FIG. 1, vertical oscillation of the trash bin 12 will not cause significant movement of the lid 14, because the track 24 extends off to the rear at a significant angle, thus precluding any relative movement of the lid 14 as a result of vertical oscillation of bin 12.

In conclusion, it is to be understood that other mechanical arrangements may be employed in place of certain of those disclosed herein. More specifically, for example, other arrangements may be provided for supporting the lid 14 in a substantially balanced manner, and other arrangements may be provided for raising and inverting the lid and trash bin assembly. Accordingly, the present invention is only to be limited by the scope of the appended claims.

What is claimed is:

1. A commercial trash bin and lid system comprising:

a large generally rectangular commercial trash bin;

means secured to said bin to facilitate raising said bin and turning it upside down to dump it;

a lid for said bin;

means for supporting said lid near its balancing point to permit easy opening of said lid;

means for guiding and restraining the rear of said lid as it is opened, said means including a pair of pins or rollers extending laterally from the top rear of the sides of said bin, and a pair of guideways secured to the rear sides of said lid, for guiding the position of the rear of said lid as it is partially opened using said supporting means while said bin is in the upright orientation;

means for stopping the movement of said lid in a partially open position when it is opened in the upright orientation;

1 said guideways extending generally upward from said pins when said lid is closed;

means for permitting said lid to swing wide open with said lid pivoting about said pins or rollers in one end of said guideways and with said supporting means inoperative, when said bin is turned upside down for dumping, with each said guideway extending to the rear from the pivot point, whereby vertical vibration of said bin to dislodge trash when said bin is in the upside-down orientation will not jam or damage said pins or guideways.

2. A commercial trash bin and lid system as defined in claim 1 wherein said lid is provided with a top and sides and wherein said guideways are secured to said sides of said lid.

3. A commercial trash bin and lid system as defined in claim 1 wherein said support means includes a pair of support rollers between said bin and said lid.

4. A commercial trash bin and lid system as defined in claim 3 wherein said stop means includes ramps for engagment with said support rollers.

5. A commercial trash bin and lid system comprising:

a large generally rectangular commercial trash bin;

means secured to said bin to facilitate raising said bin and turning it upside down to dump it;

a lid for said bin;

means for supporting said lid near its balancing point to permit easy opening of said lid;

means for guiding and restraining the rear of said lid as it is opened, said means including a pair of tracks or guideways secured to the inner rear sides of said lid and means extending laterally from the upper rear of the sides of said bin for engaging said tracks or guideways for guiding the position of the rear of said lid as it is partially opened using said supporting means while said bin is in the upright orientation;

detent means for holding said lid in a partially open position when it is opened in the upright orientation;

said tracks or guideways extending generally upward from said laterally extending engaging means when said lid is closed;

means for permitting said lid to swing wide open with said lid pivoting about one end of said tracks or guideways and with said supporting means inoperative, when said bin is turned upside down for dumping with each said track or guideway extending to the rear from the pivot point; whereby vertical vibration of said bin to dislodge trash when said bin is in the upside-down orientation will not jam or damage said tracks or guideways, or said engaging means.

6. A commercial trash bin and lid system as defined in claim 5 wherein said supporting means includes means for riding along the upper edges of said bin as said lid is opened.

7. A commercial trash bin and lid system in which (1) large commercial trash bin is provided with a lid, (2) means are secured to said bin for facilitating raising said bin and turning it upside down to dump it; (3) means are provided for supporting said lid near its balancing point to permit easy opening of said lid (4) detent means are provided for holding said lid in a partially open position, and (5) track or guideway means are provided for guiding and restraining the rear of the lid relative to the upper rear corners of said bin;

wherein the improvement comprises locating the track or guideway means in the rear inner sides of the lid and means for engaging the track secured to the upper rear sides of the trash bin, with the track or guideway means extending to the rear from the engaging means when the bin is upside down for dumping and the lid is wide open; whereby said lid is not only properly guided in movement when said trash bin is in the upright orientation, but is also restrained against vertical oscillation when the trash bin is vibrated in the upside-down orientation to dislodge trash.

8. A trash bin and lid system as defined in claim 7 wherein said track or guideway means are curved.

9. A trash bin and lid system as defined in claim 7 wherein said lid engages said bin around the entire periphery of said lid when in the closed position.

* * * * *

UNITED STATES PATENT AND TRADEMARK OFFICE

CERTIFICATE OF CORRECTION

PATENT NO. : 4,148,411

DATED : April 10, 1979

INVENTOR(S) : Allan M. Hodge

It is certified that error appears in the above-identified patent and that said Letters Patent are hereby corrected as shown below:

In claim 1, line 34, column 3, delete the arabic "1" in the margin.

Signed and Sealed this

*Thirty-first* Day of *July 1979*

[SEAL]

*Attest:*

*Attesting Officer*

LUTRELLE F. PARKER

*Acting Commissioner of Patents and Trademarks*